US009322240B2

(12) United States Patent
Corre et al.

(10) Patent No.: US 9,322,240 B2
(45) **Date of Patent: *Apr. 26, 2016**

(54) INFLATABLE PACKER WITH A REINFORCED SEALING COVER

(75) Inventors: Pierre-Yves Corre, Eu (FR); Philippe Hocquet, Vanves (FR)

(73) Assignee: Schlumberger Technology Corporation, Sugar Land, TX (US)

( * ) Notice: Subject to any disclaimer, the term of this patent is extended or adjusted under 35 U.S.C. 154(b) by 1301 days.

This patent is subject to a terminal disclaimer.

(21) Appl. No.: 11/751,367

(22) Filed: May 21, 2007

(65) Prior Publication Data

US 2007/0289735 A1 Dec. 20, 2007

Related U.S. Application Data

(60) Provisional application No. 60/805,028, filed on Jun. 16, 2006.

(51) Int. Cl.
*E21B 33/127* (2006.01)

(52) U.S. Cl.
CPC ..... *E21B 33/1277* (2013.01)

(58) Field of Classification Search
USPC ..... 166/187; 277/331, 341
See application file for complete search history.

(56) References Cited

U.S. PATENT DOCUMENTS

| | | | | |
|---|---|---|---|---|
| 2,441,894 | A | | 5/1948 | Mennecier |
| 2,511,759 | A | | 6/1950 | Williams |
| 2,581,070 | A | | 1/1952 | Blood |
| 2,600,173 | A | | 6/1952 | Sewell et al. |
| 2,623,594 | A | | 12/1952 | Sewell |
| 2,675,080 | A | | 4/1954 | Williams |
| 2,742,968 | A | | 4/1956 | Hildebrandt |
| 2,842,210 | A | | 7/1958 | Ramsey |
| 2,843,208 | A | | 7/1958 | Blood |
| 3,915,229 | A | | 10/1975 | Nicolas |
| 3,926,254 | A | | 12/1975 | Evans et al. |
| 4,236,113 | A | | 11/1980 | Wiley |
| 4,349,204 | A | * | 9/1982 | Malone ..... 277/334 |
| 4,500,095 | A | | 2/1985 | Schisler et al. |
| 4,830,105 | A | | 5/1989 | Petermann |
| 4,886,117 | A | | 12/1989 | Patel |
| 4,923,007 | A | | 5/1990 | Sanford et al. |
| 5,280,824 | A | * | 1/1994 | Eslinger et al. ..... 166/187 |
| 5,358,039 | A | | 10/1994 | Fordham |
| 5,361,836 | A | | 11/1994 | Sorem et al. |
| 5,404,947 | A | | 4/1995 | Sorem et al. |
| 5,439,053 | A | | 8/1995 | Eslinger et al. |
| 5,605,195 | A | | 2/1997 | Eslinger et al. |
| 5,613,555 | A | | 3/1997 | Sorem et al. |
| 5,687,795 | A | | 11/1997 | Patel et al. |
| 5,702,109 | A | * | 12/1997 | Mahin et al. ..... 277/340 |
| 5,778,982 | A | * | 7/1998 | Hauck et al. ..... 166/387 |

(Continued)

FOREIGN PATENT DOCUMENTS

| | | |
|---|---|---|
| EP | 0528327 | 2/1993 |
| EP | 0528328 | 2/1993 |

(Continued)

*Primary Examiner* — D. Andrew
(74) *Attorney, Agent, or Firm* — Kenneth L. Kincaid

(57) ABSTRACT

An inflatable packer includes an inflation assembly having an inner expandable bladder, an expandable support position about the bladder, and a reinforced sealing member positioned circumferentially about a portion of the support structure.

24 Claims, 2 Drawing Sheets

(56) References Cited

U.S. PATENT DOCUMENTS

| | | | | |
|---|---|---|---|---|
| 6,315,050 | B2 | 11/2001 | Vaynshteyn et al. | |
| 6,513,600 | B2 | 2/2003 | Ross | |
| 6,564,876 | B2 | 5/2003 | Vaynshteyn et al. | |
| 6,729,399 | B2 | 5/2004 | Follini et al. | |
| 6,865,933 | B1 | 3/2005 | Einarson et al. | |
| 6,938,698 | B2 | 9/2005 | Coronado | |
| 7,510,015 | B2 * | 3/2009 | Corre et al. | 166/387 |
| 2002/0014339 | A1 | 2/2002 | Ross | |
| 2002/0017386 | A1 | 2/2002 | Ringgenberg et al. | |
| 2004/0099443 | A1 | 5/2004 | Meister et al. | |
| 2004/0216871 | A1 * | 11/2004 | Mendez et al. | 166/187 |

FOREIGN PATENT DOCUMENTS

| | | |
|---|---|---|
| EP | 0702747 | 3/1996 |
| WO | 03/018956 | 3/2003 |

* cited by examiner

INFLATABLE PACKER WITH A REINFORCED SEALING COVER

RELATED APPLICATIONS

This application claims the benefit of U.S. Provisional Patent Application No. 60/805,028 filed Jun. 16, 2006.

FIELD OF THE INVENTION

The present invention relates to inflatable packers for wellbore operations.

BACKGROUND

Inflatable packers are sealing devices that may be carried on a conveyance in a retracted position into a wellbore and then expanded to provide a seal against the wellbore wall or conduit. Inflatable packers typically include an inner elastomer bladder that is connected at its ends by moveable mechanical fittings to a mandrel. Commonly, a retaining cover comprising metal slats or cables is provided over the inner bladder to serve as the principal load bearing member when the packer is set and to prevent extrusion of the bladder when it is expanded. For example, slat-type packers typically comprise metal slats that are oriented longitudinally between the mechanical end fittings of the packers. The slats are positioned to substantially overlap when the bladder is retracted so that when the bladder is expanded the slats will provide a barrier against extrusion of the bladder. While the retaining cover provides anchoring against the wall and limits longitudinal movement of the assembly in the wellbore, it does not provide a fluid seal across the inflatable packer. Thus, it is common for inflatable packers to include a thick elastomer sleeve circumferentially about a portion of the retention member to provide sealing between the packer and the wellbore.

Drawbacks in the current outer sealing covers have been realized. One drawback is that in high temperature wellbores the outer sealing cover is often damaged or fails. For example, sealing may be lost and/or portions of the outer covering may part from the packer assembly. Another drawback of the outer rubber sealing covers is that in high pressure drawdown situations, the outer rubber cover tends to distend and move past or over the top of the mechanical end fitting. Positioning of a portion of the rubber covering over the mechanical end fittings can prevent removal of the packer from its set position.

FIGS. 1A and 1B illustrate a drawback of common inflatable packers. Referring to FIG. 1A, an inflatable packer assembly is expanded so that its outer rubber covering 3 is in sealing contact with the surrounding wellbore wall 5, illustrated herein as casing. The packer mandrel, inner bladder, and retaining cover are not illustrated in FIGS. 1A and 1B. Due to high temperature and/or high pressure differential across the packer assembly, rubber covering 3 is deformed and is displaced over one of the mechanical end fittings 7 as shown in FIG. 1B.

Therefore, it is a desire of the present invention to provide an inflatable packer that addresses drawbacks of current inflatable packers. It is a still further desire to provide an inflatable packer that includes a reinforced outer sealing cover.

SUMMARY OF THE INVENTION

In view of the foregoing and other considerations, the present invention relates to wellbore packers and more specifically to an inflatable packer having enhanced high temperature and high differential pressure performance is provided.

Accordingly, a packer having an outer sealing member that is reinforced is provided. The reinforced sealing member may include reinforcing fibers contained within a sealing material. The reinforced sealing member may be constructed of an elastomer matrix with embedded fibers.

The reinforced sealing member may be positioned circumferentially about an expandable bladder. The reinforced sealing member may be positioned circumferentially about a support member. The support member may be positioned about an expandable inner bladder.

The support member may constitute metal slats. The reinforced sealing member fibers may be oriented substantially parallel to the metal slats. The support members may constitute cables. The reinforced sealing member fibers may be oriented at an angle, and thus not parallel, to the support member cables.

The foregoing has outlined the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

The foregoing and other features and aspects of the present invention will be best understood with reference to the following detailed description of a specific embodiment of the invention, when read in conjunction with the accompanying drawings, wherein.

DETAILED DESCRIPTION

Figure 1A:
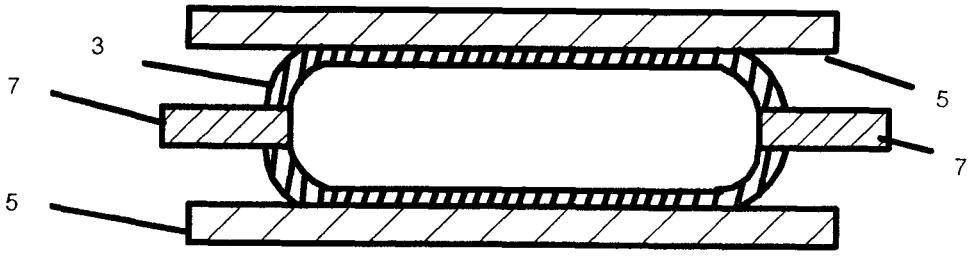
FIG. 1A (Prior Art)
FIGS. 1A and 1B are schematic drawings illustrating a common prior art inflatable packer.

Refer now to the drawings wherein depicted elements are not necessarily shown to scale and wherein like or similar elements are designated by the same reference numeral through the several views.

As used herein, the terms "up" and "down"; "upper" and "lower"; and other like terms indicating relative positions to a given point or element are utilized to more clearly describe some elements of the embodiments of the invention. Commonly, these terms relate to a reference point as the surface from which drilling operations are initiated as being the top point and the total depth of the well being the lowest point.

Figure 2A:
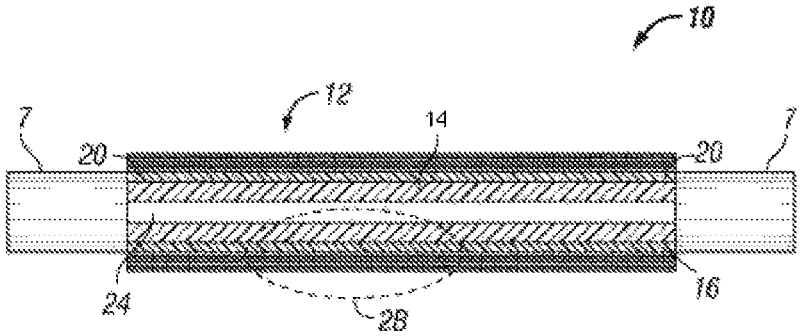
FIG. 2A is a schematic diagram of a reinforced inflatable packer of the present invention.

FIG. 2A is a schematic view of a reinforced inflatable packer, generally denoted by the numeral 10, of the present invention. Packer 10 includes a pair of mechanical end fittings 7 and inflation assembly 12. The fittings typically have two functionalities. First, fittings provide sealing between the expandable bladder and the mandrel, and secondly they are firmly attached to the cables or slats, in order to hold them when the inflation pressure and/or pressure differential is applied. The connection can be performed for example by a skirt crimped on a nipple. Other competitors weld the cables, bond them, or hold them by mechanical assembly. As is well known in the art, end fittings 7 are commonly attached to a mandrel (not shown). End fittings typically move relative to the mandrel and one another to facilitate the expansion of inflation assembly 12. Inflation assembly 12 is in the retracted or non-inflated position in FIG. 2A.

Figure 2B:
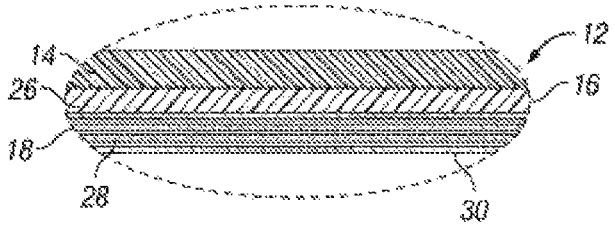
FIG. 2B is an expanded view of a portion of the inflatable assembly of the packer of FIG. 2A.

FIG. 2B is an expanded view of a section of inflation assembly 12. Inflation assembly 12 includes an inner elastomer bladder 14, a retaining and/or support structure 16, and a reinforced outer cover 18. Each of the ends 20 of at least inner elastomer bladder 14 is connected to a mechanical end fitting 7. Typically, each end of support structure 16 is connected to one of the end fittings 7. As will be recognized in the following discussion, ends 22 of outer reinforced cover 18 may or may not be connected to mechanical end fittings 7.

Figure 1B:
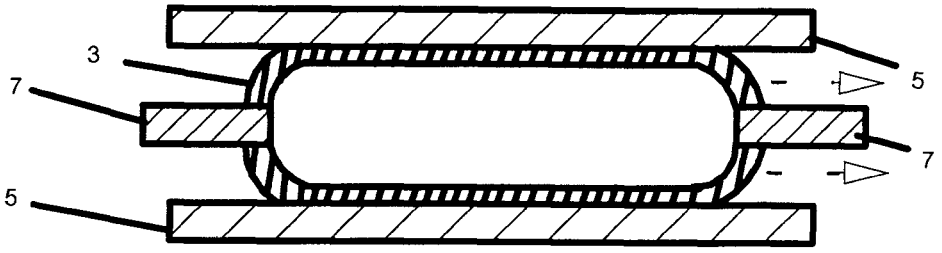
FIG. 1B (Prior Art)

Inner bladder 14 is constructed of an elastomer material such that the application of pressure in at interior 24 will expand bladder 14 and inflation unit 12 outward toward the casing wall 5 (FIG. 1). It is noted that the packer of the present invention may be utilized in open hole, and thus seal against the wellbore wall, or in a completed wellbore, and thus seal against the casing or other tubular. For purpose of description, packer 10 will be described as sealing against the wall of casing 5.

Support structure 16 surrounds bladder 14 and comprises physical structures 26, such as slats or cables, to provide load bearing support to packer 10 and to retain bladder 14 when it is expanded. In the illustrated example, support structure 16 is constituted by a plurality of metal slats 26.

It is noted that inflation assembly 12 may not include an inner bladder. In some instances, a bladder or other mechanism may be utilized to expand support structure 16 outward and into contact with the casing. In such circumstances, reinforced sealing cover 18 will provide a seal along the wall of the casing (annular seal) as well as provide a barrier to lateral fluid flow from interior 24 to the exterior of packer 10.

Slats 26 are relativity thin metal slats that partially overlap one another around the circumference of inner bladder 14. Slats 26 extend longitudinally between opposing end connections 7. As the diameter of bladder 14 is increased during expansion, adjacent ones of slats 26 slide across one another as their composite diameter is increases as well. The individual slats 26 should be wide enough so that when bladder 14 is fully expanded the central portions of the slats are pressed against the inner walls of the casing with some overlap remaining so that there are substantially no cracks or other openings through which portions of bladder 14 might extrude and be damaged.

Slats 26 provided the principle load bearing members which carry the pressure forces on the packer due to the greater pressures in the wellbore below the packer than in the annulus above it. Slats 26 also commonly provide the frictional grip on casing 5 (FIG. 1) and prevent longitudinal movement during pressuring operations in the wellbore.

Reinforced outer covering 18 is provided circumferentially about support structure 16 to prevent fluid leakage between the inner wall of casing 5 (FIG. 1) and the outer surface of the inflation assembly 12. Reinforced outer covering 18 is provided to address drawbacks in the prior inflatable packer sealing element.

Reinforced covering 18 is formed of a sealing material having reinforcement fibers 28. For example, reinforced cover may be constructed of a composite of reinforcement fibers 28 and an elastomer matrix 30. In some embodiments, the thickness of the each elastomer layer can be optimized (for example, it can be from about 0.2 mm to about 2.0 mm, such as about 0.7 mm). The total thickness of the reinforced covering 18 can be between about 3mm and about 30 mm. Examples of reinforcement fibers 28 include carbon fibers, KEVLAR fibers, fiberglass basalt fibers and thermoplastic fibers (PEEK, PPS, etc.). Examples of matrix 30 may be formed of numerous materials such as hydrogenated nitrite, hydrogenated nitrite butadiene rubber (HNBR), fluorinated elastomers (FKM), nitrite butadiene rubber (NBR), Ethylene Propylene Diene Monopolymer (EPDM), silicon based rubber, and natural rubber. The bonding between fibers 28 and matrix 30 may be improved by impregnating fibers 28 with rubber dissolution, or by chemical bonding.

It may be desired for fibers 28, to be set longitudinally relative to packer 10 or inflation assembly 12 when utilized with a slat-type support structure 16. In the described embodiment, fibers 28 are oriented substantially parallel to slats 26.

If support structure 16 includes cables, it may be desired for reinforcement fibers 28 to be set with an angle relative to the longitudinal axis of inflation assembly 12, the angle preferably from about 7° to about 20°. Orienting fibers 28 so as not to be parallel with inflation assembly 12, complements the natural shortening of reinforced cover 18 with the shortening of support structure 16 and bladder 14. In some embodiments, the fibers angle will be slightly higher than the cables angles. For example, when the outer cables are set with an angle of about 15°, the fibers will be set with an angle comprised between about 15.5 and about 20°; the fibers set close to the cables will be set with an angle close to about 15°; and the outer fibers, far from the cables, will be set with a wider angle, for example about 20°

With reference to FIGS. 1A, 1B, 2A and 2C, advantages of reinforced packer 10 of the present invention are described. Inflation assembly 12 provides structural integrity believed to improve the performance of packer 10 in high temperature and/or high pressure drawdown operations. Reinforced outer cover 18 is believed to reduce the occurrence of slip or displacement of the outer sealing element over mechanical fittings 7. Additionally, as opposed to prior art inflatable packers, if a portion of the outer sealing cover 18 of the present invention is damaged it tends to be held in physical connection with the outer cover. Accordingly, the potential for packer 10 to stick in the wellbore due to engagement of a portion of sealing cover 18 with the incompressible end connections 7 is reduced.

From the foregoing detailed description of specific embodiments of the invention, it should be apparent that an inflatable packer that is novel has been disclosed. Although specific embodiments of the invention have been disclosed herein in some detail, this has been done solely for the purposes of describing various features and aspects of the invention, and is not intended to be limiting with respect to the scope of the invention. It is contemplated that various substitutions, alterations, and/or modifications, including but not limited to those implementation variations which may have been suggested herein, may be made to the disclosed embodiments without departing from the spirit and scope of the invention as defined by the appended claims which follow.

What is claimed is:

1. An inflatable packer having an inflation assembly connected between end fittings, the assembly comprising:

an inner bladder defining an axial length thereof; and a sealing member positioned circumferentially about and extending substantially along the entire axial length of the inner bladder, wherein the sealing member comprises an elastomeric matrix with reinforcement fibers disposed therein formed as a composite structure to strengthen the sealing member, wherein the sealing member is not directly connected to the end fittings.

2. The assembly of claim 1, wherein the reinforcement fibers are not directly connected to the end fittings.

3. The assembly of claim 2, wherein the fibers are selected from the group consisting of carbon fibers, fiberglass, basalt fibers, and thermoplastic fibers.

4. The assembly of claim 2, wherein the elastomeric matrix is selected from the group consisting of hydrogenated nitrite, fluorinated elastomers, nitrite butadiene rubber, EPDM, silicon based rubber, and natural rubber.

5. The assembly of claim 4, wherein the fibers are selected from the group consisting of carbon fibers, KEVLAR fibers, and thermoplastic fibers.

6. An inflatable packer having an inflation assembly connected between end fittings, the assembly comprising:

an expandable support structure defining an axial length thereof; and a sealing member positioned circumferentially about and extending substantially along the entire axial length of the expandable support structure, wherein the sealing member comprises an elastomeric matrix with reinforcement fibers disposed therein formed as a composite structure to strengthen the sealing member, wherein the sealing member is not directly connected to the end fittings.

7. The assembly of claim 6, wherein the reinforcement fibers are not directly connected to the end fittings.

8. The assembly of claim 6, wherein the fibers are selected from the group consisting of carbon fibers, fiberglass, basalt fibers, and thermoplastic fibers.

9. The assembly of claim 6, wherein the elastomeric matrix is selected from the group consisting of hydrogenated nitrite, fluorinated elastomers, nitrite butadiene rubber, EPDM, silicon based rubber, and natural rubber.

10. The assembly of claim 9, wherein the fibers are selected from the group consisting of carbon fibers, KEVLAR fibers, EPDM, silicon based rubber, and thermoplastic fibers.

11. The assembly of claim 6, wherein the expandable support structure comprises metal slats.

12. The assembly of claim 11, wherein the reinforced sealing member include fibers, the fibers oriented substantially parallel to the metal slats.

13. The assembly of claim 6, wherein the expandable support structure comprises cables, wherein the cables are helically set at an angle relative to the longitudinal axis of the support structure and wherein the reinforcement fibers are set a different angle relative to the longitudinal axis of the support structure.

14. An inflatable packer having an inflation assembly connected between end fittings, the assembly comprising:

an inner bladder;

an expandable support structure positioned circumferentially about the inner bladder to serve as a load bearing member for the inflatable packer structure and defining an axial length thereof; and a sealing member positioned circumferentially about and extending substantially along the entire axial length of the expandable support structure, wherein the sealing member comprises an elastomeric matrix with reinforcement fibers disposed therein formed as a composite structure to strengthen the sealing member, wherein the sealing member is not directly connected to the end fittings.

15. The assembly of claim 14, wherein the expandable support structure comprises cables, wherein the cables are helically set at an angle relative to the longitudinal axis of the inflation assembly and wherein the reinforcement fibers are set a different angle relative to the longitudinal axis of the inflation assembly.

16. The assembly of claim 14, wherein the expandable support structure comprises metal slats.

17. The assembly of claim 16, wherein the metal slats and the fibers are oriented substantially parallel to one another.

18. The assembly of claim 16, wherein the fibers are selected from the group consisting of carbon fibers, and thermoplastic fibers.

19. The assembly of claim 16, wherein the elastomeric matrix is selected from the group consisting of hydrogenated nitrite, fluorinated elastomers, nitrite butadiene rubber, and natural rubber.

20. The assembly of claim 19, wherein the fibers are selected from the group consisting of carbon fibers, KEVLAR fibers, and thermoplastic fibers.

21. The assembly of claim 14, wherein the expandable support structure comprises cables.

22. The assembly of claim 21, wherein the cables are connected to the end fittings.

23. The assembly of claim 21, wherein the expandable support structure is connected to the end fittings.

24. The assembly of claim 14, wherein the reinforcement fibers are not directly connected to the end fittings.

* * * * *